United States Patent [19]

Martin et al.

[11] 3,955,512

[45] May 11, 1976

[54] REFUSE INCINERATOR

[75] Inventors: Walter Josef Martin; Heinz Weiand, both of Munich, Germany

[73] Assignee: Josef Martin Feuerungsbau GmbH, Munich, Germany

[22] Filed: Oct. 29, 1974

[21] Appl. No.: 518,867

[30] Foreign Application Priority Data

Nov. 30, 1973 Germany ..... 2359730

[52] U.S. Cl. ..... 110/8 R; 110/17; 110/23

[51] Int. Cl.[2] ..... F23G 5/00; F23M 3/18

[58] Field of Search ..... 110/7 R, 8 R, 10, 12, 110/15, 17, 23

[56] References Cited

UNITED STATES PATENTS

| | | | |
|---|---|---|---|
| 1,263,512 | 4/1918 | Begemann | 110/12 |
| 2,070,520 | 2/1937 | Allen | 110/12 |
| 2,796,198 | 6/1957 | Weigel et al. | 110/7 X |
| 3,050,202 | 8/1962 | Funk | 110/7 X |
| 3,223,058 | 12/1965 | Tanner | 110/10 |
| 3,533,365 | 10/1970 | Tanner et al. | 110/15 |
| 3,592,149 | 7/1971 | Mutke et al. | 110/15 |
| 3,780,674 | 12/1973 | Liu | 110/17 |

*Primary Examiner*—Kenneth W. Sprague
*Attorney, Agent, or Firm*—Michael J. Striker

[57] ABSTRACT

A combustion chamber is arranged above a burner grate, and a fragmentizing device fragmentizes refuse and forwards it to the combustion chamber in form a mix composed of lighter and heavier refuse particles. The lighter refuse particles become combusted in the combustion chamber whereas the heavier refuse particles drop out of the combustion chamber through an opening of the same and become deposited on the burner grate where they themselves become combusted.

19 Claims, 12 Drawing Figures

REFUSE INCINERATOR

BACKGROUND OF THE INVENTION

The present invention relates to a refuse incinerator.

The incineration of refuse for disposal purposes is well known. It is also known to fragmentize refuse in suitable equipment in order to obtain light particles which are light enough so that they can float and subsequently to combust these particles while they float in air in a combustion chamber. A prior-art installation operating on this principle has equipment for grinding the refuse and blowing the resulting particles into the combustion chamber.

However, experience has shown that this is not generally a practicable approach, because due to the heterogeneous composition of the refuse which is admitted into the fragmentizing device the latter will produce not particles of more or less uniform size, but will instead produce a mix of larger and smaller particles. If it is desired to be able to combust the refuse in floating condition in a combustion chamber, then the larger particles which are as a rule heavier than the smaller ones must be returned into the fragmentizing equipment, or must be forwarded to a separate fragmentizer, in order to be sufficiently reduced in size. Even then, many particles cannot be sufficiently reduced, in which case these particles must then be removed from the remainder of the comminuted refuse, and must be otherwise disposed of, or transported to a conventional burner grate on which they can be combusted. This latter approach, however, requires a relatively large supply of excess air for the combustion of the particles on the burner grate, in order to avoid slag melts and also eliminate strands or flows of non-combusted gases which may lead to corrosion effects. Excess air, however, that is air in excess of that required for combustion, results in a loss of thermal energy and thus makes the prior-art incinerators, which are usually constructed so that their heat can be usefully recovered, less effective than they could be.

SUMMARY OF THE INVENTION

It is therefore a general object of this invention to provide an improved refuse incinerator which is not possessed of the disadvantages of the prior art.

More particularly, it is an object of the present invention to provide such an improved incinerator which is capable of combusting all combustible refuse, irrespective of particle size.

Another object of the invention is to provide such an improved incinerator which offers significantly improved recovery of its combustion heat.

In keeping with these objects, and with others which will become apparent hereafter, one feature of the invention resides, in a refuse incinerator, in a combination comprising a burner grate, a combustion chamber above the grate, and supply means for supplying a mix of lighter and heavier refuse particles to the combustion chamber, for combustion of the lighter particles therein. Means is provided for admitting the uncombusted heavier particles from the combustion chamber onto the grate so that they become combusted on the same.

Any items of the refuse which cannot be reduced sufficiently in size in the fragmentizing equipment wherein the incoming refuse is fragmentized, that is particles which after fragmentizing are still larger than the aforementioned heavier particles, can be admitted onto the grate directly, that is without having to pass first through the combustion chamber.

The arrangement according to the present invention makes it possible to combust all solid refuse in a single refuse incinerator, since the light-weight particles which can float are combusted in the combustion chamber whereas all other particles are combusted on the burner grate. It is a substantial advantage of the concept of providing the separate combustion chamber for the lighter particles above the burner grate, that it is now no longer necessary to carry out fragmentizing of the incoming refuse in several stages until all of the refuse has been fragmentized to a small enough particle size to be combusted while floating in air in a combustion chamber. Instead, a one-stage fragmentizing with a subsequent separation of the fractions in the mix is sufficient, one fraction undergoing combustion in the combustion chamber and the other fraction undergoing combustion on the burner grate.

As opposed to a prior-art incinerator in which all refuse particles must be combusted while floating in air in a combustion chamber, the present invention has the advantage that the amount of energy necessary for fragmentizing the incoming refuse is substantially reduced. Moreover, since the separation into the lighter and heavier fraction of the mix effectively takes place in the combustion chamber itself, lesser quantities of sand, dust and metal particles will be carried along by the combustion gases, whereby the content of such materials in the combustion gases vented to the atmosphere is reduced and the errosions and fouling which are produced by such materials when the combustion gases are used to heat burners or the like, are decreased. Moreover, this is accomplished without having to provide separate equipment for removing dust, sand or the like, and without removing from the refuse any combustible substances, which is what takes place in the prior art when separate equipment is provided which frequently removes combustible substances along with sand, dust and the like.

It is currently preferred to construct the combustion chamber as a cyclone chamber with water-cooled walls. In such a chamber the refuse particles can be combusted in a turbulent air-particle mixture with lesser excess air and at higher temperature than in the case of combustion on a burner grate. The lesser amount of excess air results in lesser heat losses and also makes is possible to dimension any subsequent equipment to which the combustion gases are to be supplied, such as electrofilters, boilers, conduits and the like, smaller than would otherwise be possible. Moreover, a cyclone combustion chamber makes it possible in a very simple manner to separate those heavier particles which do not become combusted, or become only insufficiently combusted, and to discharge these particles from the combustion chamber so that they can subsequently be properly combusted on a burner grate. Moreover, the use of a cyclone-type combustion chamber makes it possible to operate with a high air speed, so that a rapid and more complete combustion of the lighter or smaller particles at higher combustion temperature and lesser excess air is obtained.

The heavier particles which are not or inadequately combusted in the combustion chamber, may either be allowed to drop onto the grate under the influence of gravity or else can be allowed to fall onto a transporting arrangement which then transports them to the burner grate. This transporting arrangement may itself be constructed as a grate with bottom drafts, of which one or more may be provided.

The combustion chamber may be elongated and have a substantially horizontal axis, or it may have a substantially vertical axis. Several chambers may be combined and cooperate with a single burner grate, and these chambers may be arranged in parallel with one another, located at the corners of a grate or may be arranged in a boxer-type system, in order to further improve the combustion capacity of the incinerator.

The combustion chamber itself may have any desired shape, arrangement and construction, as long as it is capable of fulfilling the purposes of the present invention, namely to combust the lighter weight particles and to permit the heavier particles to descend out of the combustion chamber and onto the burner grate, either directly or indirectly.

Because of the high combustion temperature which can be obtained with an arrangement according to the present invention, especially in a cyclone-type combustion chamber where it is obtainable due to the low excess air and the concentrated combustion, is possible to admix with the solid refuse liquid waste, such as sewage sludge or the like, including industrial waste such as water-oil mixtures, and to obtain effective combustion. This concept is already known from the prior art, but in the normal refuse burners of the prior art which operate at lower temperatures than the one according to the present invention, only comparatively small quantities of such liquid waste can be admitted to the solid refuse, whereas much larger quantities can be utilized in the incinerator according to the present invention. The admixture of the liquid to the solid refuse may take place directly in the cyclone-type combustion chamber or in the conduit supplying the refuse, namely ahead of the fragmentizing equipment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
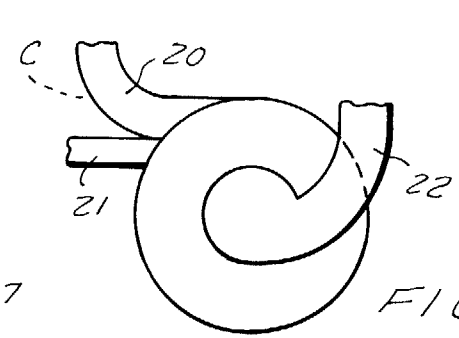
FIG. 2 is an end view as seen in the direction of the arrow I in FIG. 1.
Figure 3:
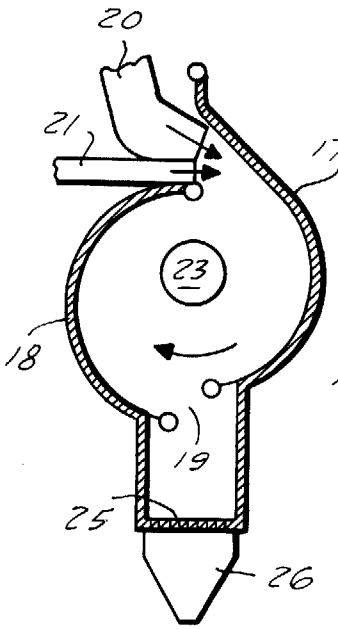
FIG. 3 is a section on line III—III of FIG. 1.
Figure 1:
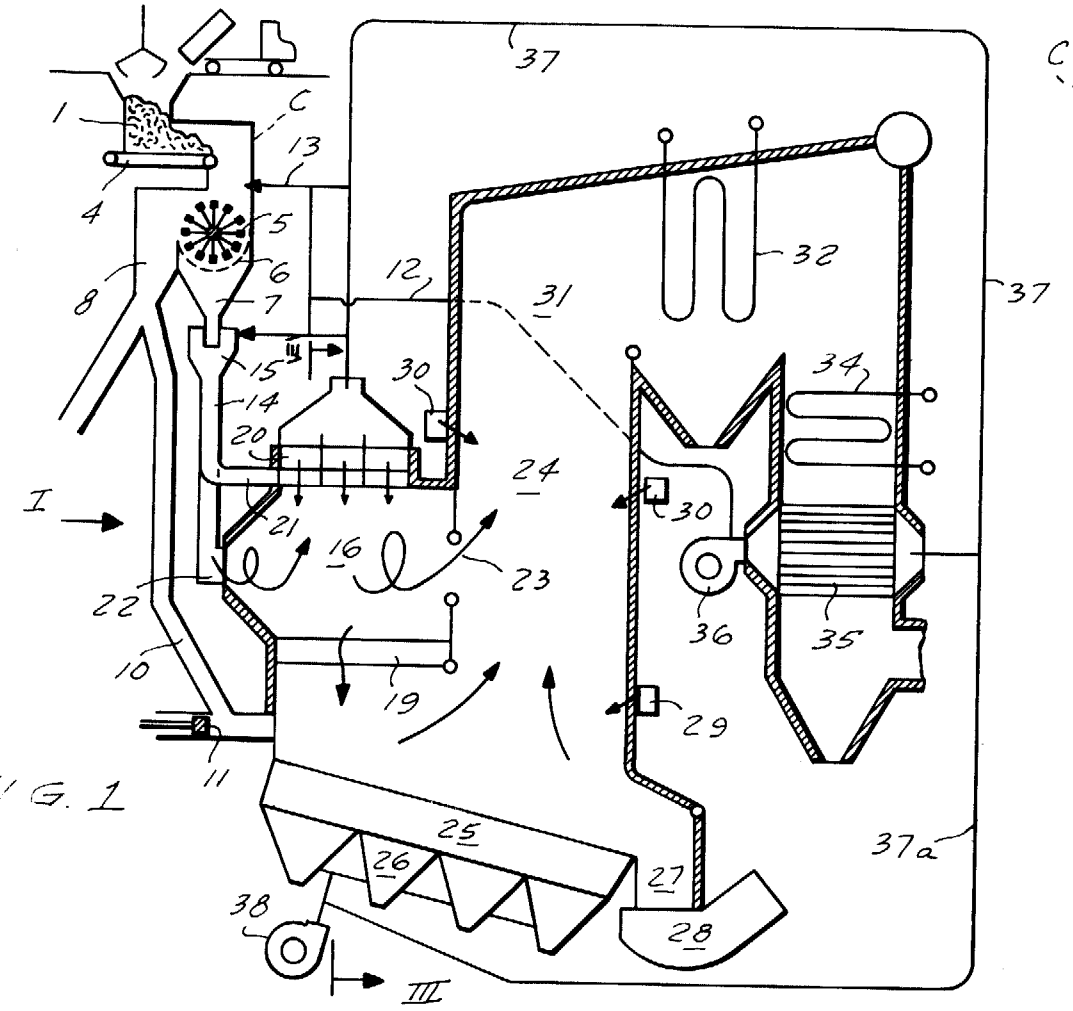
FIG. 1 is a somewhat diagrammatic side view illustrating one embodiment of the invention.

Referring firstly to the embodiment in FIGS. 1 – 3, it will be seen that the refuse, for example the collected refuse of a municipality, is admitted via an inlet 1 onto for example a conveyor belt 4, or another suitable device, such as a vibratory trough conveyor, from where it travels into a fragmentizer 5 to be fragmented therein, that is to be reduced in size. The device 5 is well known in the art and requires no description. Ahead of the device 5 the flow of incoming refuse may have admixed, via the diagramatically illustrated conduit C, a flow of liquid refuse, such as sewage sludge or the like.

The mix of lighter and heavier refuse particles issuing at the outlet end of the fragmentizing device 5 travels through a screen 6 or analogous arrangement into a funnel or hopper 7 and from there into a conduit 14. Coarse refuse which cannot be fragmentized by the device 5 or are not sufficiently fragmentized, is expelled via a hopper 8 and either removed or supplied via a passage 10 and a feeding device 11 to a burner grate 25 for combustion thereon.

An injector 15 or similar device supplies air downstream of the device 5, or else the air is supplied ahead of the device 5 via a conduit 13. This air serves as carrier for the refuse particle mix and may be either cold air derived from the conduit 12 and/or hot air derived from a conduit 37. Especially in the case of hot air, this will serve to obtain a pre-heating and partial drying of the refuse either in or downstream of the device 5.

The refuse particle mix travels via the conduit 14 either into a conduit 21 or into a conduit 22. FIG. 3 shows that from the conduit 21 the refuse with the combustion air is blown tangentially through a longitudinal slot 20 formed at the circumference of a horizontally arranged cyclone-type combustion chamber 16. A conduit C is diagrammatically illustrated to indicate that liquid refuse can also be admitted at this point, either in addition to that or in lieu of that admitted upstream of the device 5. The slot 20 also serves to admit combustion air via the conduit 37. FIG. 2 shows that the current of air and entrained refuse particle mix could also be admitted via the conduit 22 which communicates with the cyclone-type combustion chamber 16 at one axial end thereof so that the stream would enter in an axial direction rather than in tangential direction. In order to obtain a spiral flow in this case, the conduit 22 is curved as illustrated.

The combustion chamber 15 itself is composed of two relatively offset cylindrically or spirally curved shells 17 and 18 which are so arranged that in the upper region they form with one another a longitudinal slot 20, and in the lower region of the chamber 16 they form with one another a longitudinal slot 19. The heavier particles of the mix of refuse become separated due to the cyclon-effect in the chamber 16, that is due to the essentially spiral flow therein, and drop out through the slot 19 whereas the lighter particles float in the chamber 16 and become combusted therein. The longitudinal axis of the chamber 16 is horizontal or approximately horizontal, and the chamber 16 is located upwardly above the grate 25 so that in this embodiment the heavier particles which drop out through the slot 19 will fall onto the grate 25 for combustion thereon, together with any other particles that may have been admitted directly via the device 11.

The grate 25 is provided with one or more bottom drafts 26 supplying sufficient air to combust the particles which drop onto the grate, including those derived from the slot 19 of the combustion chamber 16 which particles may be either uncombusted or partially combusted by the time they leave the chamber 16. Any slag remaining on the grate 25 drops through a shaft 27 at the lower end of the grate 25 into a slag remover 28. The slag remover 28 is well known in the art.

The combustion gases obtained from the combustion of the finer particles in the chamber 16 leave the latter via a central outlet opening 23 at one end of the chamber 16 and enter into a main combustion chamber 24 which extends upwardly from the grate 25 and into which the combustion gases from the latter also enter. Secondary air nozzles 29 are arranged upwardly of the grate 25, and additional secondary air nozzles 30 are arranged upwardly of the grate opening 23 of the combustion chamber 16. These nozzles communicate with the main combustion chamber 24 and assure intensive combustion of the combustion gases that enter the chamber 24.

Subsequently, the combustion gases from the chamber 25 flow in known manner through the diagrammatically illustrated portion 31 of a boiler, possibly but not necessarily through a superheater 32, an economizer 34 and an air pre-heater 35.

A fresh air blower 36 blows air through the air preheater 35 into the conduit 37 so that the preheated air is admitted from the conduit 37 into the slot 20 of the combustion chamber 16 where it serves as combustion air. Combustion air for the grate 25 can be supplied as cold air by a blower 38 or as hot air by the blower 36 via a conduit 37*a* which admits it into the individual bottom drafts 26.

Figure 5:
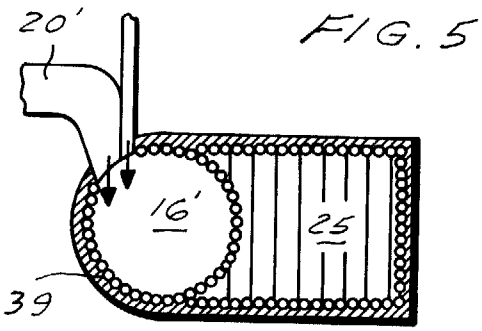
FIG. 5 is a section on line V—V of FIG. 4.
Figure 4:
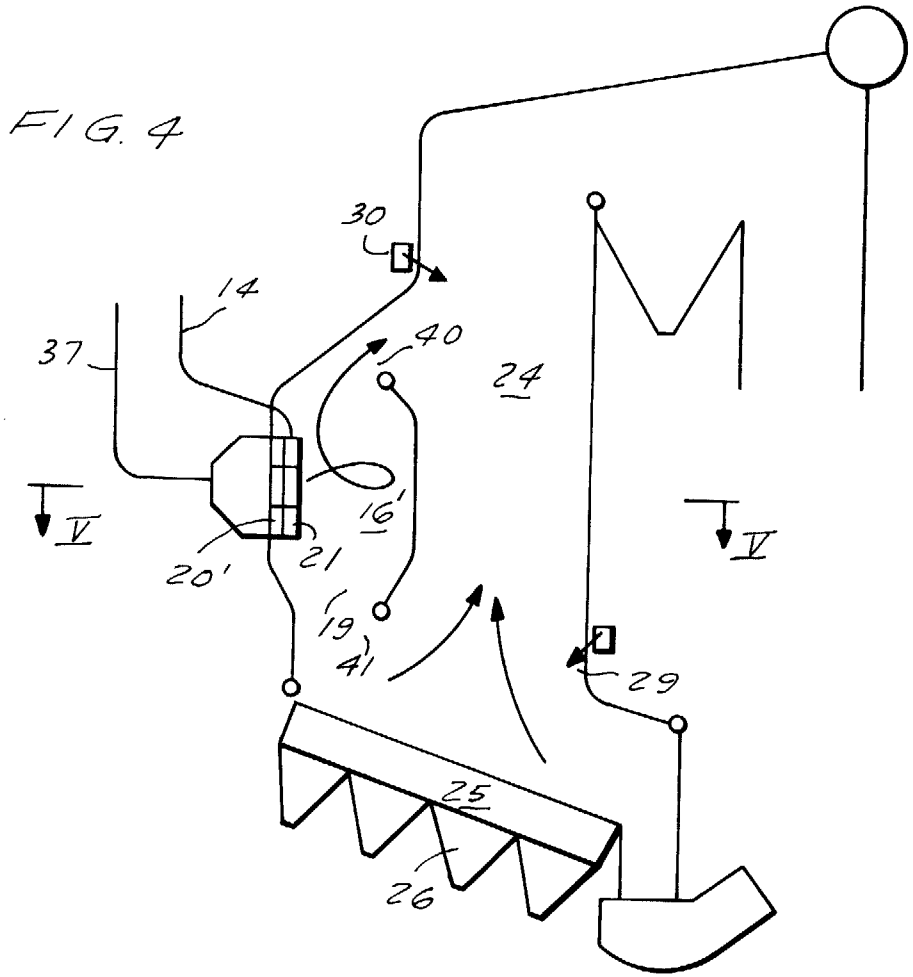
FIG. 4 is view analogous to FIG. 1 but illustrating a further embodiment of the invention.

A further embodiment of the invention is illustrated in FIGS. 4 and 5. Here, the cyclon-type combustion chamber is identified with reference numeral 16 and has a vertical axis rather than a horizontal one. In this embodiment the entraining air and the refuse particle mix are admitted via the conduit 14 into the conduit 21 which communicates with a longitudinal slot 20' in the cylindircal wall 39 of the combustion chamber 16', as shown in FIG. 5. The wall 39 converges on the upper and lower ends of the chamber 16' to form openings 40 and 41.

In this embodiment, the air entering through the slot 20' travels in a spiral flow 42 in upward direction, and during this flow the floating refuse particles become ignited and combusted whereupon the combustion gases leave through the opening 40 and enter the main combustion chamber 24. The heavier uncombusted or incompletely combusted particles of the refuse drop through the lower opening 41 onto the grate 25 where they become combusted. Combustion gases from the grate 25 merge in the region of the secondary air nozzles 30 with the gases that issue from the opening 40 of the combustion chamber 16'.

Figure 6:
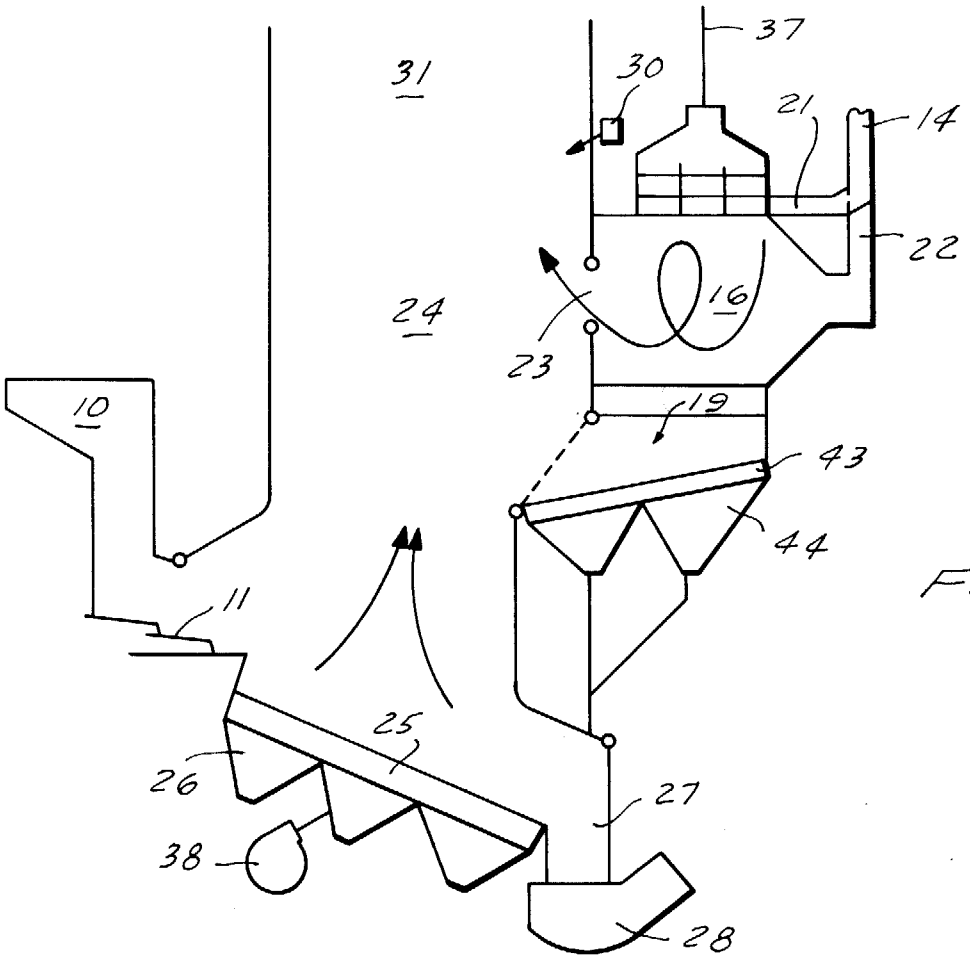
FIG. 6 is a view analogous to FIG. 4, illustrating another embodiment of the invention.

According to still another embodiment as shown in FIG. 6 a combustion chamber 16 is provided which corresponds to the one shown in FIG. 1 and has a substantially horizontal axis. It is positioned over a transporting arrangement that is constructed as a grate 43 having bottom drafts 44 and onto which the heavier refuse particles drop through the slot 19 of the combustion chamber 16. The grate 43 transports these particles onto the grate 25 for further combustion.

The embodiment of FIG. 6 illustrates how the addition of one or more cyclone-type combustion chambers 16 and associated transport arrangements such as the grate 43, can be carried out in already existing refuse incinerators in order to improve the effectiveness thereof. Such incinerators would already have the grate 25, so that only the addition of the combustion chamber or chambers 16 and possibly of the transporting arrangement 43 wold be required to increase the efficiency.

Figures 7A, 7B, 8A, 8B, 9A, 9B:
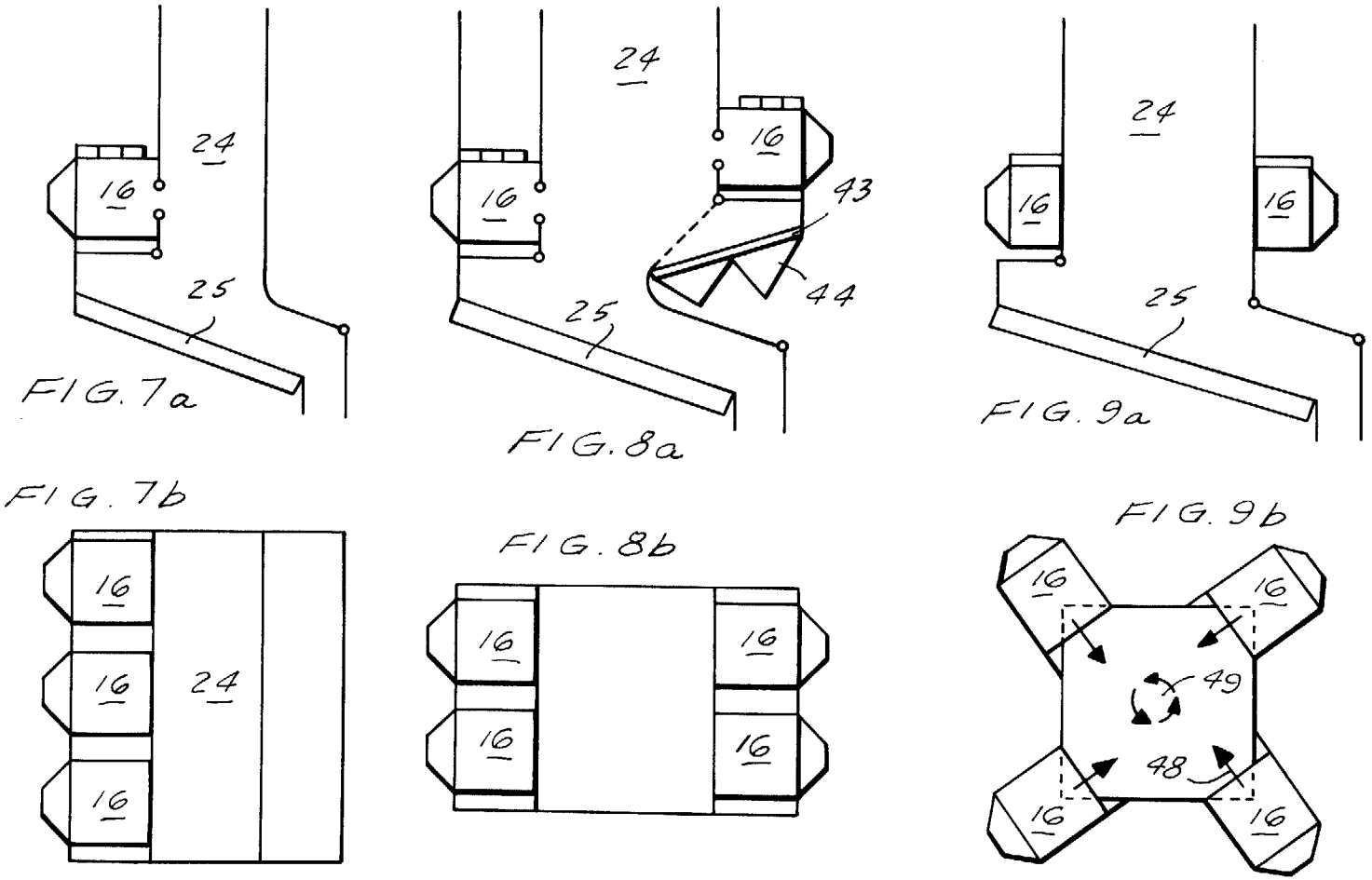
FIGS. 7*a* and 7*b* are diagrammatic side views and top plan views, respectively, of a further embodiment.
FIGS. 8*a* and 8*b* are views similar to FIGS. 7*a* and 7*b* but illustrating another embodiment.
FIGS. 9*a* and 9*b* are views similar to FIGS. 8*a* and 8*b*, but show still a further embodiment of the invention.

FIGS. 7*a* and 7*b* are self-explanatory and it will be seen that several of the combustion chambers 16 shown in FIG. 1 are combined in a parallel arrangement. These all cooperate with a single main combustion chamber 24 and a combustion or burner grate 25. In other words, FIGS. 7*a* and 7*b* show an arrangement analogous to FIG. 1 except that several of the chambers 16 are arranged in parallel with one another.

A similar arrangements is shown in FIGS. 8*a* and 8*b* where the combustion chambers 16 are arranged in a boxer-type arrangement. In other words, two of the chambers 16 of the embodiment of FIG. 1 are arranged in parallel next to one another, and opposite them there are arranged two further ones which themselves are arranged in parallel and next to each other. Here, again the four combustion chambers cooperate with a main combustion chamber 24 and a grate 25 as in FIG. 1.

Finally, FIGS. 9*a* and 9*b* show an embodiment wherein four of the combustion chambers 16 of FIG. 1 are arranged at the corners of a main combustion chamber 24 of approximately quadratic cross-section. The axis 48 of the chambers 16 are so arranged that they are tangent to an imaginary circle 49 at the center of the main combustion chamber 24. The chambers 16 may be located at different vertical levels. A common grate 25 is again provided as before.

It will be understood that each of the elements described above, or two or more together, may also find a useful application in other types of constructions differing from the types described above.

While the invention has been illustrated and described as embodied in a refuse incinerator, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a refuse incinerator, a combination comprising a main first combustion chamber having a lower end region; a burner grate in said lower end region; a second combustion chamber upwardly of said burner grate and independent of said first combustion chamber; discrete combustion air supply means for supplying combustion air to said second chamber; material supply means for supplying a mix of lighter and heavier refuse particles to said second combustion chamber, for combustion of the lighter particles therein; and admitting means for admitting the uncombusted particles of the mix from said second combustion chamber into said first combustion chamber and onto said burner grate for combustion thereon.

2. A combination as defined in claim 1, wherein said admitting means comprises an opening in a wall bounding said second chamber, through which said heavier particles drop onto said grate.

3. A combination as defined in claim 1, wherein said admitting means comprises means for conveying said heavier particles from said chamber towards said second grate.

4. A combination as defined in claim 1, wherein said material supply means comprises fragmentizing means for fragmentizing the incoming refuse and thereby obtain said mix.

5. A combination as defined in claim 1, wherein said second chamber is constructed as a cyclone burner chamber.

6. A combination as defined in claim 3, wherein said conveying means comprises a conveying grate.

7. A combination as defined in claim 1, wherein said second chamber is elongated and has a substantially horizontal axis, and a circumferential wall formed in a lower part of said second chamber with a longitudinal slot constituting at least part of said admitting means.

8. A combination as defined in claim 7, wherein said wall is formed with an additional longitudinal slot constituting said supply means for the admission of combustion air.

9. A combination as defined in claim 8; and further comprising conduit means connecting said material supply means with said additional longitudinal slot so that said mix is admitted together with said combustion air.

10. A combination as defined in claim 8; and further comprising conduit means connecting said material supply means with an axial end of said second chamber for admitting said mix thereinto.

11. A combination as defined in claim 8, wherein said wall is cylindrical and composed of two shell sections having respective facing edge portions which define with one another said slots.

12. A combination as defined in claim 5, wherein said second chamber is elongated and has a substantially vertical axis, at least one tangential inlet for said mix and the combustion air, an upper opening for discharge of combustion gases, and a lower outlet for said heavier particles which constitutes at least in part said admitting means.

13. A combination as defined in claim 1; and further comprising additional ones of said second combustion chambers, similar to the first-mentioned one and also arranged above said burner grate.

14. A combination as defined in claim 1; and further comprising means for feeding liquid wastes into said second chamber.

15. A combination as defined in claim 1, wherein said material supply means comprises a conduit communicating with said second chamber, and a fragmentizer interposed in said conduit for fragmentizing incoming refuse to obtain said mix.

16. A combination as defined in claim 15; and further comprising means for feeding liquid wastes into said conduit ahead of said fragmentizer.

17. In a refuse incinerator, a combination comprising a burner grate; a combustion chamber above said grate; a main combustion chamber also above said grate and laterally adjacent to the first-mentioned chamber, said main combustion chamber communicating with said grate and with said first-mentioned chamber; supply means for supplying a mix of lighter and heavier refuse particles to said first-mentioned combustion chamber, for combustion of the lighter particles therein; and means for admitting the uncombusted particles from said first-mentioned combustion chamber into said main combustion chamber and onto said grate so that they become combusted on the same.

18. In a refuse incinerator, a combination comprising a burner grate; a combustion chamber above said burner grate; supply means for supplying a mix of lighter and heavier refuse particles to said combustion chamber for combustion of the lighter particles therein; and conveying means including a conveying grate, for conveying the uncombusted particles of the mix from said combustion chamber onto said burner grate for combustion thereon.

19. In a refuse incinerator, a combustion comprising a burner grate; an elongated combustion chamber above said grate and having a substantially horizontal axis and a circumferential wall; supply means for supplying a mix of lighter and heavier refuse particles into said chamber, for combustion of the lighter particles therein; and admitting means, including a longitudinal slot formed in said wall in a lower part of said chamber, for admitting the uncombusted particles of said mix from said chamber onto said grate so that they become combusted on the same.

* * * * *